United States Patent [19]

Minnick

[11] Patent Number: 4,987,682

[45] Date of Patent: Jan. 29, 1991

[54] SAFETY DEVICE FOR UTILITY KNIVES AND THE LIKE

[76] Inventor: Debra K. Minnick, 13816 Leo Rd., Leo, Ind. 46765

[21] Appl. No.: 380,792

[22] Filed: Jul. 17, 1989

[51] Int. Cl.[5] ..... B26B 29/00

[52] U.S. Cl. ..... 30/295; 30/289

[58] Field of Search ..... 30/2, 286, 294, 293, 30/295, 123.6, 317

[56] References Cited

U.S. PATENT DOCUMENTS

| | | | |
|---|---|---|---|
| 1,299,084 | 4/1919 | Wilson . | |
| 1,574,641 | 2/1926 | Christopherson . | |
| 2,376,887 | 5/1945 | Walters . | |
| 2,387,032 | 10/1945 | Lowry . | |
| 2,901,824 | 9/1959 | Zullo . | |
| 3,781,988 | 1/1974 | Jones | 30/2 |
| 4,086,698 | 5/1978 | Sparks | 30/2 |
| 4,091,537 | 5/1978 | Stevenson, Jr. | 30/286 |
| 4,531,286 | 7/1985 | Vito et al. | 30/2 |
| 4,587,735 | 5/1986 | Walters et al. | 30/286 |
| 4,607,432 | 8/1986 | Montgomery | 30/294 |
| 4,675,996 | 6/1987 | DuBuque | 30/2 |

*Primary Examiner*—Douglas D. Watts

*Attorney, Agent, or Firm*—Woodard, Emhardt, Naughton, Moriarty & McNett

[57] ABSTRACT

A safety attachment for a knife has a yoke member adapted to at least partially encircle the body of the knife a short distance behind the blade. A substantially planar guard plate is hingedly attached to the yoke member to freely swing about an axis located at or below the knife body. In a cutting position, the guard plate extends rearwardly from the axis and the blade, skimming the top of the workpiece. Upon contact with a sizable obstruction, the guard plate pivots about the obstruction to a guard position wherein the guard plate forms a solid barrier between the cutting edge of the knife blade and the obstruction, thereby preventing contact between the obstruction and the knife blade.

13 Claims, 5 Drawing Sheets

SAFETY DEVICE FOR UTILITY KNIVES AND THE LIKE

FIELD OF THE INVENTION

The present invention relates to the field of cutting instruments and attachments therefor, and, in particular, to a safety device for utility knives and the like.

BACKGROUND OF THE INVENTION

For each cutting task, there is an appropriate knife. One of the most universally used knives is the all-purpose or utility knife wherein a two-half body, when clamped together, holds a razor or similar blade extending from one end thereof. Although these knives are used and abused for nearly every cutting task imaginable, probably the most common application is to make a cut in a planar workpiece (such as cardboard or Sheetrock TM) by inserting the blade downward into the workpiece and exerting downward and pulling forces thereby drawing the knife toward oneself. The user often holds the workpiece stationary by placing his free hand, palm down, on top of the workpiece or by positioning his body up against the workpiece. All too frequently, because of inattentiveness, a dull blade or an obstruction in the workpiece, the knife is pulled directly across the cutter's own hand or against his body causing potentially serious injury. Another problem is that the utility knife user often forgets, or intentionally fails (for convenience) to retract the blade of the knife during non-use. A retractable knife in this condition or a knife of the unretractable type poses an inherently dangerous risk to the inattentive or rushed worker or to a subsequent user. Many who use these knives, along with companies and their insurers whose employees are continually being injured in utility knife accidents, have been searching for a simple and inexpensive guard for these types of knives.

Devices which have been developed to make these deceptively dangerous tools safer have been only moderately successful. Examples of such devices are disclosed in the following U.S. Pat. Nos.: 4,675,996 issued to DuBuque; 4,587,735 issued Walters et al.; 4,531,286 issued to Vito et al.; 4,091,537 to Stevenson, Jr.; 4,086,698 issued to Sparks; 3,781,988 issued to Jones and 2,376,887 issued to Walters. The devices disclosed in these patents, while providing some added degree of safety, often present an awkward tool which the user tires of due to the inconvenience. Despite the risk of injury, the user is tempted to abandon the awkward tool and return to the unguarded standard utility knife for its convenience.

What is needed is a safety device for utility knives and the like which is simple, inexpensive, and does not interfere with the cutting routine.

SUMMARY OF THE INVENTION

Figure 1:
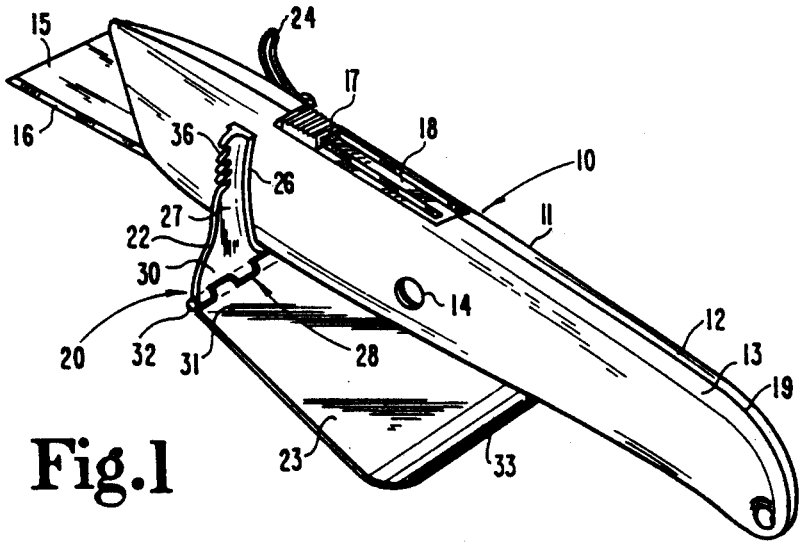
FIG. 1 is a perspective view of the safety device adapted for use with a standard utility knife in accordance with the preferred embodiment of the present invention and shown in the cutting position.

Generally speaking, there is provided a safety attachment for utility knives and the like which swings freely between a cutting position and a guard position. The attachment is activated both by gravity and by contact with an obstruction during a cutting stroke along a planar surface.

The attachment includes a yoke member which is adapted to be firmly connected to the body of the utility knife just behind the blade. A generally rectangular guard plate is hingedly connected to the yoke member to pivot freely along an axis just at or below the knife body and through an angle of approximately 180°. In a cutting position, the guard plate extends rearwardly from the axis and the blade, skimming the top of the workpiece. Upon contact with a sizable obstruction, the guard plate pivots about the obstruction to a guard position wherein the guard plate forms a solid barrier between the cutting edge of the knife blade and the obstruction, thereby preventing contact between the obstruction and the knife blade.

Alternative embodiments are contemplated wherein the knife body provides the means for hingedly holding the guard plate.

It is an object of the present invention to provide a safer cutting device.

It is another object of the present invention to provide a safety attachment which can easily be added or removed to the standard utility knife.

Other objects and advantages of the present invention will become obvious from the following description of the preferred embodiment.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
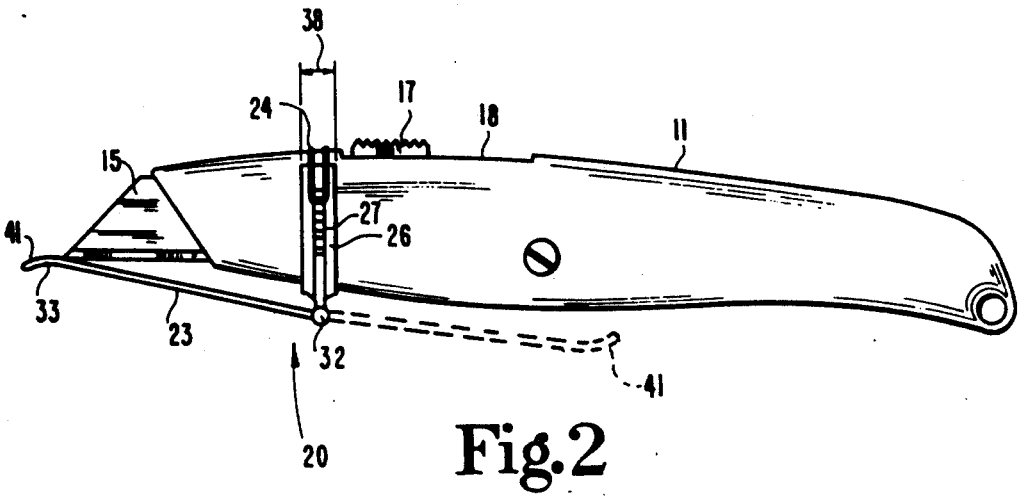
FIG. 2 is an elevational side view of the device and knife of FIG. 1, but shown in the guard position.
Figure 3:
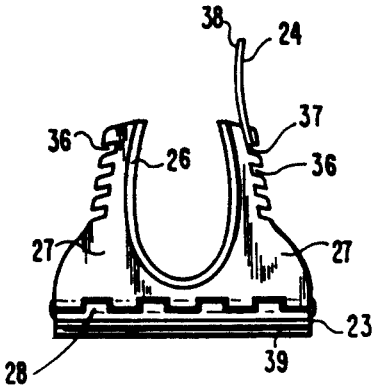
FIG. 3 is an end view of the device of FIG. 1.
Figure 4:
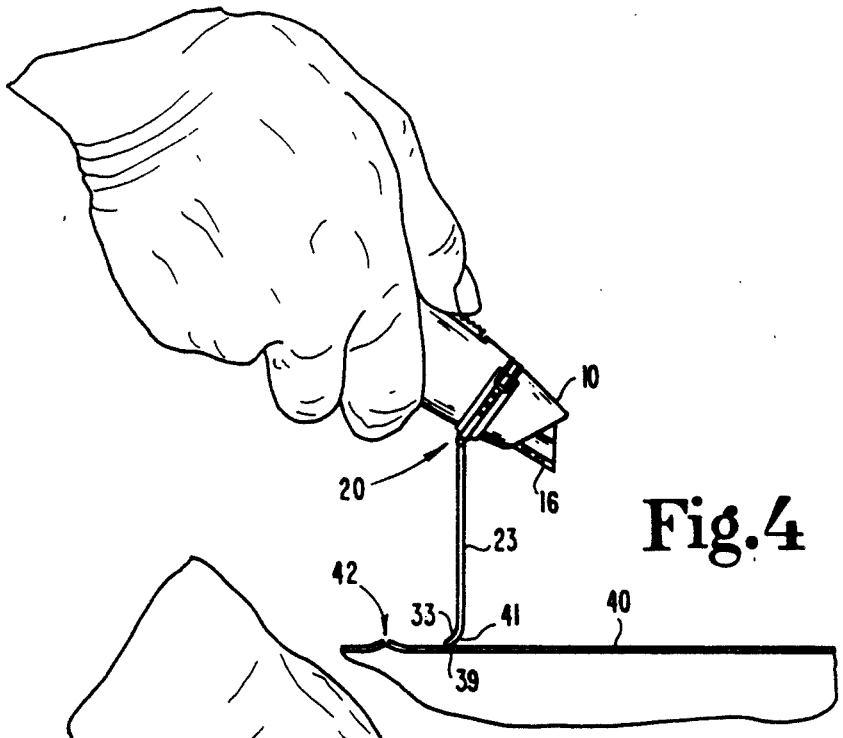
FIGS. 4–7 show incremental stages of use of the safety device and knife of FIG. 1.

Referring now to FIGS. 1–3 there is shown a safety device 20 in accordance with the preferred embodiment of the present invention. In particular, safety device 20 is shown here adapted for use with a standard utility knife 10. Knives of this type generally include a pair of mating body pieces 12 and 13 which are held together by a screw 14 to form knife body 11. A blade 15 having a downwardly facing cutting edge 16 is held for sliding movement within body 11. Movement of thumb piece 17 within track 18 moves blade 15 (via a mechanism contained within body 11) between an extended position (FIG. 1) and a retracted position (not shown) wherein the entire blade 15 is encased within body 11. It is to be understood that knife 10 is merely representative of standard knives having an elongate handle with a blade extending outwardly from one end of the knife.

Knife 10 and safety device 20 are both substantially symmetrical about a vertical plane which cuts between body pieces 12 and 13 at joint 19.

Safety device 20 includes a U-shaped yoke member 22, a guard plate 23 and an attachment strap 24. Yoke member 22 is integrally formed from a suitable plastic material such as polyurethane. Yoke member 22 defines a U-shaped collar 26 which at least partially encircles knife body 11. Yoke member 22 is molded to substantially conform to the outer body configuration of the standard utility knife at an area just forward of track 18. Collar 26 has a width 38 of approximately 3/16ths to one-quarter of an inch to provide additional stability to its connection to knife body 11. Yoke member 22 also defines a support flange 27 which extends outwardly and downwardly from collar 26. At its bottom 30, support flange 27 defines one-half of hinge 28.

Guard plate 23 is substantially rectangular and is formed from a suitably strong but somewhat resilient material such as polyurethane. One edge 31 of guard plate 23 forms the other half of hinge 28. A hinge pin 32 joins hinge halves 30 and 31 together. The sizing of hinge halves 30 and 31 and of hinge pin 32 is such that there is virtually no frictional inhibition to the pivotal movement between yoke member 22 and guard plate 23 due to hinge 28. The edge 33 of guard plate 23 which is opposite hinge half 31 is curved or bent slightly as shown in FIG. 2, thereby forming an arcuate lower surface 41.

The means for securing yoke member 22 to knife 11 is provided in the present embodiment by attachment strap 24 and by a series of outwardly-opening notches 36 defined in both sides of support flange 27 (best shown in FIG. 3). To attach safety device 20 to knife 11, knife 11 is positioned downward within complementary-shaped collar 26. One end 37 of attachment strap 24 is positioned within an appropriate notch 36 on one side of yoke member 22. The other end 38 of strap 24 is pulled and stretched over the top of knife body 11 and is positioned within an appropriate notch 36 on the other side of yoke member 22. There are a number of notches 36 provided at differing heights along both sides of support flange 27 in order to assure that knife body 11 may be held firmly within yoke member 22 and to provide for slight size variations among different brands of knives.

As shown in FIG. 2, when safety device 20 is appropriately attached just forward of track 18, guard plate 23 may freely swing or pivot about an axis defined by hinge pin 32. Guard plate 23 may swing between a guard position (shown in solid lines) wherein plate 23 extends forwardly of hinge pin 32 and is disposed below blade 15, and a cutting position (shown in dashed lines) wherein plate 23 extends rearwardly from hinge pin 32 and from blade 15. With the pivoting axis (at 32) of guard plate 23 being substantially at or below the bottom of knife body 11, plate 23 is pivotable through approximately 180°.

Referring now to FIGS. 4–8, the operation of safety device 20 as adapted for use with utility knife 10 will now be described.

Figure 5:
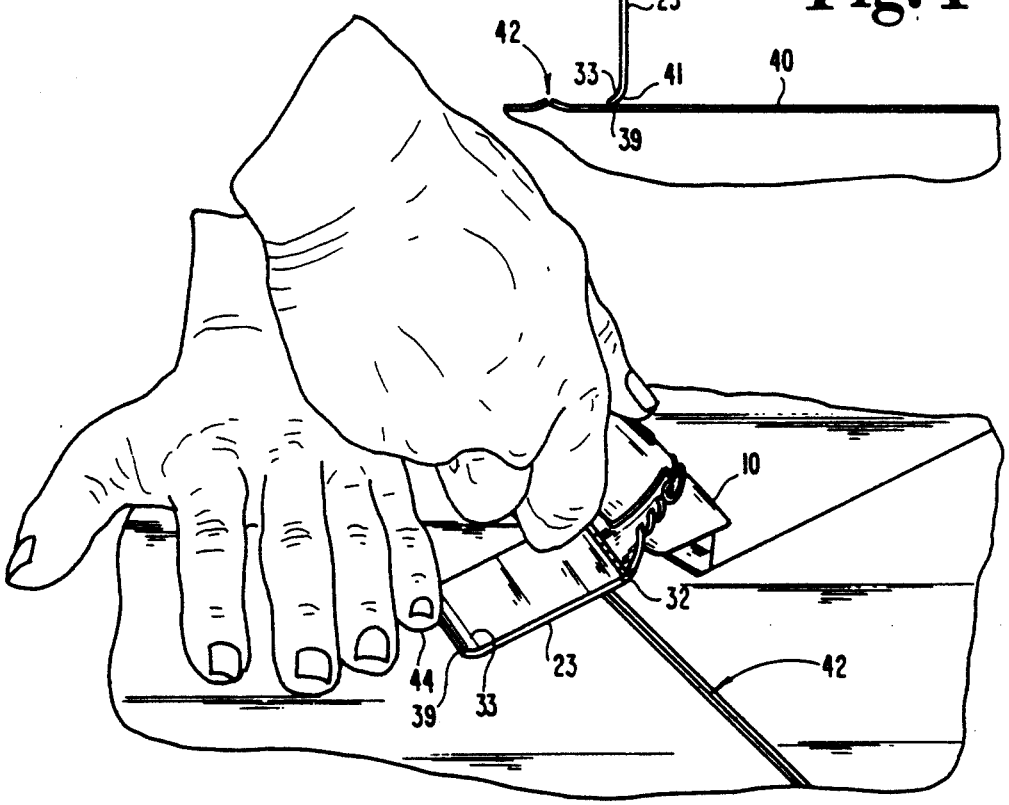
Figure 6:
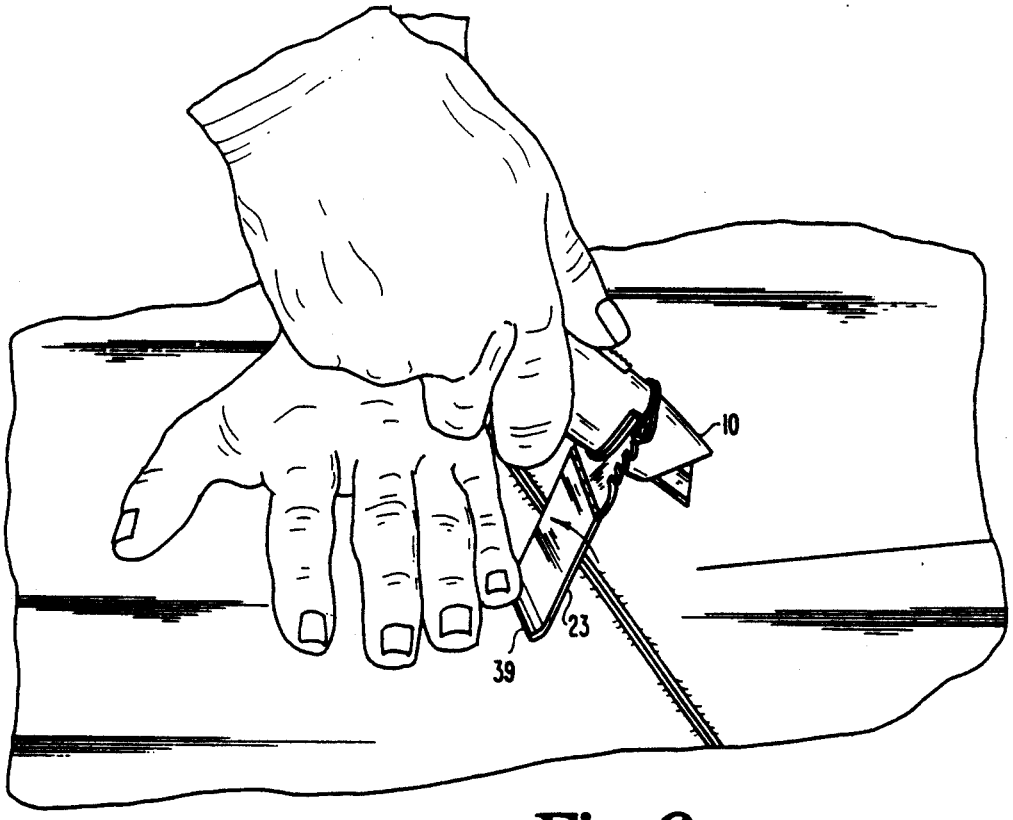

Knife 10 is grasped in a normal manner. The size of safety device 20 as well as its location on the forward end of knife 10 is such that device 20 does not get in the way or create an inconvenience to the grasping or use of knife 10. With cutting edge 16 pointing downward and with guard plate 23 hanging vertically due to gravity, knife 10 is lowered until leading edge 39 of curved section 33 touches the workpiece 40 (a cardboard carton, for example). Just a slight forward motion of knife 10 will pivot guard plate 23 about edge 39 so that the arcuate lower surface 41 of curved section 33 will begin to contact the carton surface. Slight downward pressure of knife 10 translates through arcuate lower surface 41 causing a camming effect which causes curved section 33 of guide plate 23 to move rearwardly along the surface of carton 40. Knife blade 15 is pushed downward against the surface of carton 40, puncturing it, and is then drawn rearwardly as shown in FIG. 5. When a slight imperfection 42 in the surface of carton 40 (such as a puncture or seam) is reached, arcuate lower surface 41 of curved section 33 cams over the imperfection 42 permitting guide plate 23 to pass on by without interrupting the cutting stroke. However, when leading edge 39 of guard plate 23 meets an object (such as fingers 44) having a generally vertical height (measured from the surface of carton 40) greater than the height of leading edge 39 (measured from the surface of carton 40), arcuate surface 41 does not contact fingers 44 and there is therefore no camming effect by arcuate surface 41 to lift guard plate 23. Instead, either the object (the workman's fingers 44) is pushed out of the way by guard plate 23, or guard plate 23 is stopped at its curved section 33. In the latter case, as shown in FIG. 6, curved edge 33 becomes a pivot point for guard plate 23. The drawing or cutting stroke of the workman is usually very quick and the dynamic momentum associated with the pulling action strongly urges knife 11 to continue to be drawn rearwardly after plate 23 contacts fingers 44. With curved section 33 no longer in a sliding relationship, but in a pivoting relationship with carton 40, knife 11 will move rearwardly and slightly upwardly, pivoting both about curved section 33 and hinge pin 32 (FIG. 6).

Figure 7:
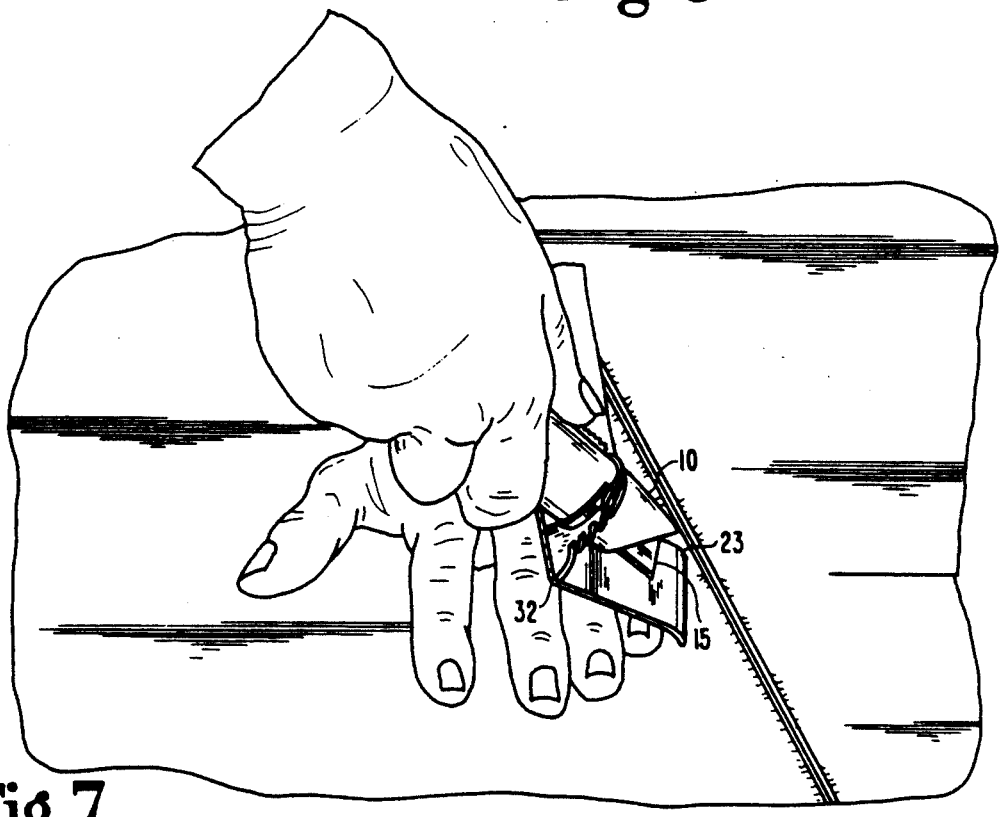

Referring to FIG. 7, at the end of this motion, safety device 20 has gone from the cutting position of FIG. 5 to the guard position wherein guard plate 23 extends forwardly of hinge pin 32 and rests below and adjacent blade 15. Under conventional circumstances, without safety device 20, the entire cutting stroke may last only about one second and it is usually too late for the workman to stop the pulling action of the knife in time to avert blade contact with fingers. As shown in FIG. 7, however, with safety device 20 attached, by the time knife 10 is drawn over the fingers, guard plate 23 is positioned completely between blade 15 and the workman's fingers, thereby avoiding injury due to blade 15.

It should be noted that the length of guard plate 23 from its connection at hinge 28 to the opposite side at curved section 33 should be such that, when safety device 20 is properly attached to knife 10, guard plate 23 will extend along the entire length of cutting edge 16 and form a solid barrier between cutting edge 16 and an object therebelow as shown in FIGS. 2 and 7.

As noted above, collar 26 is shaped to conform to the outer body configuration of a standard utility knife. Even with slight variations in the outer body configuration among differing brands of utility knives, it is believed that the present device will provide sufficient surface area contact between the collar and the knife body and will provide a tight enough grip due to the securement of attachment strap 24, to keep safety device 20 firmly attached to the standard utility knife 10. The present invention is particularly adaptable to short-bladed knives such as utility knives, but is also recommended for other specific-task knives such as tile cutters. In such cases, the yoke member 22 of the particular safety device would define a collar 26 which was appropriately shaped for the particular knife.

Alternative embodiments are contemplated wherein the securing means would be other than the elastic attachment strap 24. For example, an attachment strap might be formed as an integral part with the yoke member and have a series of apertures therein which would correspond with one or more posts on the opposite side of the yoke member. The attachment means should at least provide a manner of firmly securing the device 20 to a knife so that the device 20 when plate 23 contacts a large object, the path of the knife is interrupted and the knife pivots about the guard plate and the object rather than having the device be pushed off the end of the knife.

Figure 8:
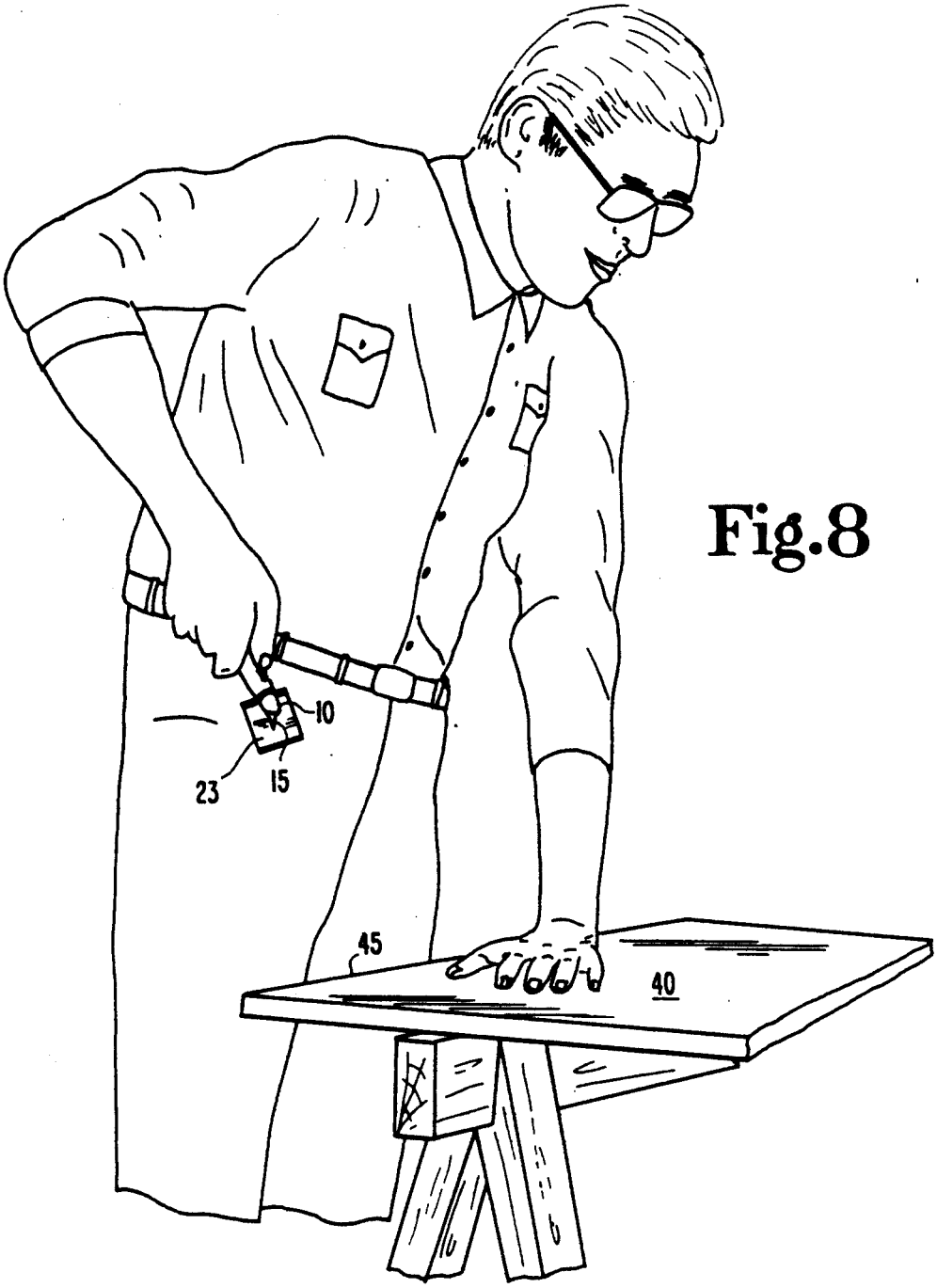
FIG. 8 shows another instance of operation of the device of FIG. 1.

As shown in FIG. 8, another frequent type of cutting injury is caused when a heavy resistance to the drawing force of the cutting stroke is suddenly removed causing the knife to lurch rearwardly, whereby the blade may strike the workman. Because guard plate 23 swings freely, once knife 10 is pulled away from or behind the workpiece 40, gravity will cause guard plate 23 to swing and hang downwardly as soon as it rises above the surface or passes the end 45 of workpiece 40. By the time knife 10 reaches the workman's body, guard plate 23 is hanging between the workman's body and blade 15, preventing blade 15 from coming in contact with the workman's body.

Figure 9:
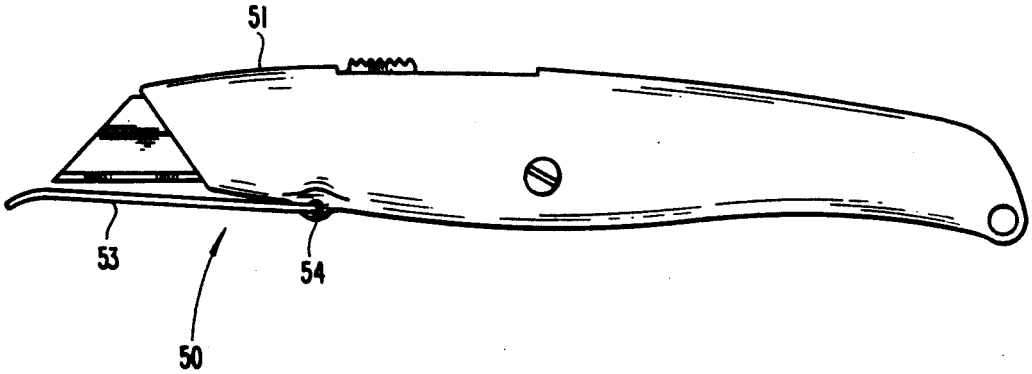
FIG. 9 is an elevational side view of the safety device in accordance with another embodiment of the present invention.

Another embodiment is shown in FIG. 9 wherein safety device 50 is integrally formed with the body of knife 51. In this embodiment, guard plate 53 is pivotally mounted to the body of knife 51 by an appropriate hinge member 54. The guard plate of this embodiment may be identical to plate 23 of device 20 in FIG. 1 with the body of knife 51 being formed to define the upper half of hinge member 54.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A safety attachment for a knife having a knife body and a blade extending from an end of the body, the blade having a cutting edge, the attachment comprising:

a yoke member adapted to at least partially encircle the body of the knife;

a guard plate hingedly connected to said yoke member at a hinge, said plate adapted to swing freely between a cutting position wherein said plate extends rearwardly from said hinge and from said blade and a guard position wherein said plate extends forwardly from said hinge and below said blade; and securing means for firmly securing said yoke member in position about the body.

2. The safety attachment for a knife of claim 1 wherein said yoke member defines a U-shaped collar for receipt of the body, said yoke member and collar defining a pair of upstanding posts and said securing means including strap means, tightly securable between said posts, for extending between said posts and, when the body is received within said collar, around a portion of said body such that said collar and said strap means completely encircle the body.

3. The safety attachment for a knife of claim 1 wherein said plate is sized and shaped to form a solid barrier between the entire length of the cutting edge and any object disposed below said plate when said plate is in said guard position.

4. The safety attachment for a knife of claim 3 wherein said plate pivots between said cutting position and said guard position about an axis defined by said hinge which is located below the body.

5. The safety attachment for a knife of claim 4 wherein said yoke member defines a U-shaped collar adapted to extend partially around the body, said yoke member and collar defining a pair of upstanding posts, and wherein said securing means includes strap means adapted to tightly extend between said posts and around the remainder of the body not surrounded by said yoke.

6. The safety attachment for a knife of claim 5 wherein said yoke member and plate are made of plastic.

7. The safety attachment for a knife of claim 1 wherein said plate has a proximal end connected at said hinge and an opposite distal end, the distal end defining an arcuate surface which faces downward when said plate is in the cutting position.

8. A knife and safety plate combination, comprising:

a knife body having an end, a bottom and a knife blade extending forwardly from the end of said body and having hinge means at the bottom for hingedly receiving a guard plate; and a guard plate means hingedly connected to said body by said hinge means, said plate adapted to swing freely between a cutting position wherein said plate extends rearwardly from said hinge and from said blade and a guard position wherein said plate extends forwardly from said hinge and below said blade guarding the length of the blade against any cutting action.

9. The knife and safety plate combination of claim 8 wherein said knife blade defines a cutting edge and wherein said plate is sized and shaped to form a solid barrier between the entire length of the cutting edge and any object disposed below said plate when said plate is in said guard position.

10. The knife and safety plate combination of claim 9 wherein said plate pivots between said cutting position and said guard position about an axis defined by said hinge means, the axis being defined no higher than the cutting edge.

11. The knife and safety plate combination of claim 8 wherein said plate means has a proximal end connected at said hinge means and an opposite distal end, the distal end defining an arcuate surface which faces downward when said plate is in the cutting position.

12. A safety attachment for a knife having a knife body and a blade extending from an end of the body, the blade having a cutting edge, the attachment comprising:

hinge means for hingedly connecting a guard plate to the knife, said hinge means defining an axis; and a guard plate means connected to the knife by said hinge means and adapted to swing freely between a cutting position wherein said plate extends rearwardly from said axis and from said blade and a guard position wherein said plate extends forwardly from said axis and below said blade guarding the length of the blade against any cutting action.

13. A knife and guard combination, comprising:

a knife having a body with an end and a bottom and a knife blade extending forwardly from the end of said body and having hinge means at the bottom for hingedly receiving a guard member, and wherein the blade has a cutting edge; and a guard member hingedly connected to said body by said hinge means, said guard member adapted to swing freely between a cutting position wherein said guard member extends rearwardly from said hinge and from said blade and a guard position wherein, when the cutting edge is facing downwardly, said guard member extends forwardly from said hinge and is generally aligned with and below said blade, and wherein the cutting edge cannot extend below said guard member.

* * * * *